United States Patent [19]

Saito

[11] Patent Number: 4,712,301

[45] Date of Patent: Dec. 15, 1987

[54] SAFETY RAZOR

[75] Inventor: Tatsuya Saito, Seki, Japan

[73] Assignee: Kai Cutlery Center Co., Ltd., Gifu, Japan

[21] Appl. No.: 514,588

[22] Filed: Jul. 18, 1983

[51] Int. Cl.[4] ..... B26B 21/00

[52] U.S. Cl. ..... 30/47; 30/85

[58] Field of Search ..... 30/47, 85, 86, 32; 16/110 R

[56] References Cited

U.S. PATENT DOCUMENTS

| | | | |
|---|---|---|---|
| 1,875,990 | 9/1932 | Christmas . | |
| 1,985,132 | 12/1934 | Woods | 30/12 |
| 1,991,290 | 2/1935 | McGirr et al. | 30/12 |
| 2,075,007 | 3/1937 | Christmas | 30/17 |
| 2,407,516 | 9/1946 | Roberts | 30/47 |
| 2,455,528 | 7/1948 | Keogh, Jr. | 30/41 |
| 2,563,802 | 8/1951 | Denslow | 30/47 |
| 2,716,810 | 9/1955 | Koval | 30/47 |
| 2,716,811 | 9/1955 | Case | 30/47 |
| 2,871,560 | 2/1959 | Eberbaugh | 30/47 |
| 3,492,722 | 2/1970 | Sieve | 30/47 |
| 4,439,920 | 4/1984 | Hauheimer | 30/47 |

FOREIGN PATENT DOCUMENTS

| | | |
|---|---|---|
| 45-11748 | 1/1970 | Japan . |
| 53-11186 | 4/1978 | Japan . |
| 1562173 | 3/1980 | United Kingdom . |

*Primary Examiner*—Douglas D. Watts

*Attorney, Agent, or Firm*—Stephen G. Rudisill

[57] ABSTRACT

A safety razor has a handle or grip foldable into a box-shaped case. The handle is made of a thin plastics blank having a multiplicity of bending lines. In use, the blank is folded into the handle having a rectangular cross section. When not in use, the blank is folded into a case with a blade holder which carries a blade being accommodated therein. The blade holder is separate from the handle and can be mounted on a blade holder mount integraly formed with an upper end of the handle. Stiffening ribs are attached to and disposed between the handle and the blade holder mount for preventing the blade holder mount from being vibrated up and down during use.

8 Claims, 15 Drawing Figures

SAFETY RAZOR

BACKGROUND OF THE INVENTION

The present invention relates to a safety razor in the form of a blank having a plurality of bending lines enabling the blank to be folded selectively into a handle or grip in an operative condition for use and into a box-shaped configuration in an inoperative condition for storage.

Safety razors of the type described comprise a blade holder integrally formed with an upper end of a razor handle or grip with a bending line therebetween and foldable for holding a blade, as disclosed in Japanese Laid-Open Patent Publication No. 53-111864 and British Pat. No. 1,562,173. In use, the blade holder is folded along the bending line into perpendicular relation to the handle or grip. The known safety razor is disadvantageous in that during use, the blade holder together with the blade tends to vibrate up and down at the bending line, resulting in difficulty in shaving.

SUMMARY OF THE INVENTION

It is an object of the present invention to provide a safety razor composed of a blank foldable selectively into a box-shaped configuration that can be carried when not in use and into a razor handle or grip for use as an ordinary razor.

Another object of the present invention is to provide a safety razor having a foldable blank which can easily be varied in shape from a box-shaped configuration to a handle or grip and vice versa.

Still another object of the present invention is to provide a safety razor including a foldable blank and a blade holder mount which are rigidly interconnected with no bending line therebetween, so that a blade holder will be prevented from vibrating up and down through the blade holder mount during use to thereby facilitate shaving.

Still another object of the present invention is to provide a safety razor having a blade holder mount reinforced with stiffening ribs to prevent a blade holder from vibrating up and down, thereby facilitating shaving.

A still further object of the present invention is to provide a safety razor composed of a blank foldable into a box-shaped case capable of accommodating therein shaving cream, for example.

A still further object of the present invention is to provide a safety razor having a foldable blank including a portion serving as stiffening ribs for reinforcing a blade holder mount, thus dispensing with other special stiffening ribs.

A yet further object of the present invention is to provide a safety razor composed of a blank foldable into a case which cannot be collapsed easily.

According to the present invention, there is provided a safety razor comprising a thin plastics blank having a plurality of transverse and longitudinal bending lines defined thereon, the blank being foldable selectively around selected ones of the bending lines into a razor handle of a rectangular cross section and around other bending lines than the selected ones into a box-shaped case, a blade holder mount integrally formed with an upper edge of the blank, and a blade holder separate from and adapted to be mounted on the blade holder mount, the blade holder being accommodatable in the case and having a blade mounted thereon.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
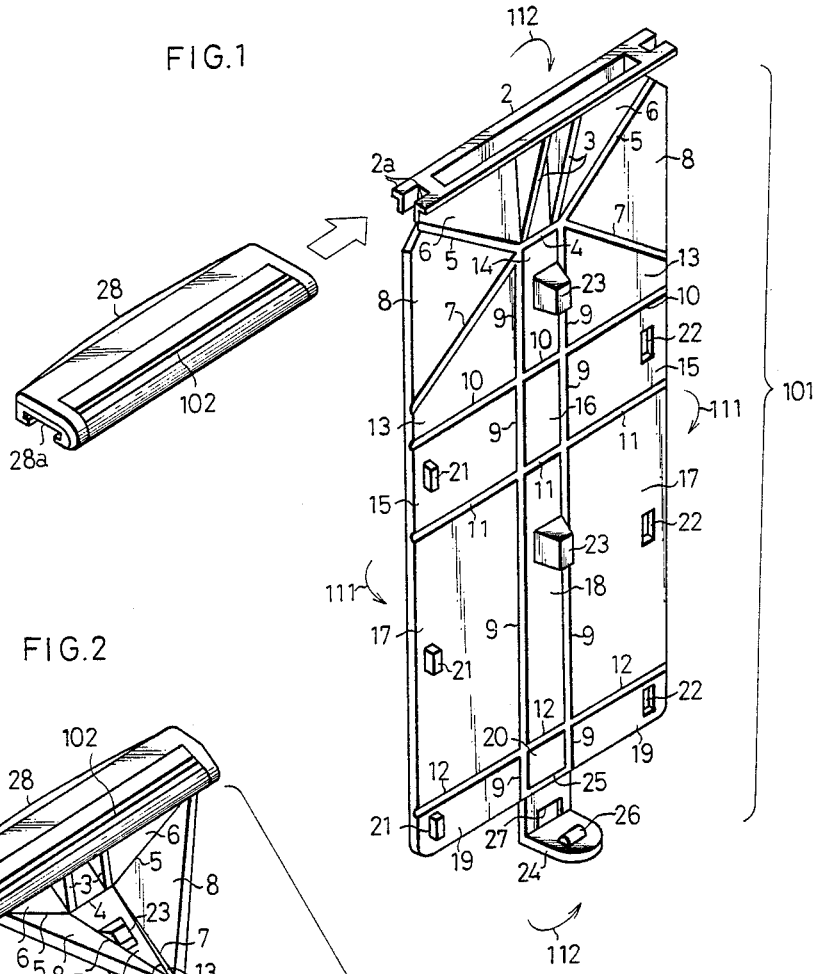
FIG. 1 is an exploded perspective view of a safety razor according to a first embodiment of the present invention, showing a unfolded blank of the safety razor and a blade holder.

FIGS. 1 through 4 show a safety razor constructed in accordance with a first embodiment of the present invention. A blank 101 shown unfolded in FIG. 1 is made of plastics in the form of a rectangular thin sheet. A blade holder mount 2 is integrally formed on an upper edge of the blank 101 and projects forward thereof, the blade holder mount 2 having substantially the same width as that of the blank 101. The blank 101 has a pair of triangular stiffening ribs 3 positioned centrally on a front surface of the blank at the upper edge thereof and mounting the blade holder mount 2 at a front central portion thereof.

The blank 101 has a short transverse bending line 4 extending laterally between lower ends of the stiffening ribs 3 and defined in the front surface of the blank 101.

The bending line 4 and other bending lines which will be described below are in the form of grooves defined in the blank 101. The blank 101 also has a pair of upwardly oblique upper bending lines 5, 5 defined in the front surface of the blank 101 and extending from opposite ends of the bending line 4 obliquely upwardly toward upper lateral corners of the blank 101. The bending line 4, the bending lines 5, 5, and the upper edge of the blank 101 jointly define a pair of lateral upper blade holder supports 6, 6 of triangular configurations. A pair of downwardly oblique bending lines 7, 7 is defined in the front surface of blank 101 and extends from the ends of the bending line 4 obliquely downwardly to transverse edges of the blank 101. The bending lines 7, 7, the bending lines 5, 5, and the transverse edges of the blank 101 jointly define a pair of triangular laterally lower blade holder supports 8, 8.

A pair of parallel longitudinal bending lines 9, 9 is defined in the front surface of the blank 101 and extends from the ends of the bending line 4 downwardly toward a lower edge of the balnk 101. An upper transverse bending line 10 is defined in the front surface of the blank 101 and extends between the transverse edges of the blank 101 slightly below the bending lines 7, 7. The bending line 10, the bending lines 9, 9, the bending lines 7, 7, and the transverse edges of the blank 101 jointly define a pair of trapezoidal side walls 13, 13. The bending line 10, the bending lines 9, 9, and the bending line 4 jointly provide a rectangular rear wall 14.

An intermediate transverse bending line 11 is defined substantially centrally in the front surface of the blank 101 and extends between the transverse edges of the blank 101 parallel to the upper transverse bending line 10. The bending line 11, the bending line 10, the bending lines 9, 9, and the transverse edges of the blank 101 jointly define a pair of rectangular side walls 15, 15. The bending line 11, the bending line 10, and the bending lines 9, 9 jointly provide a rectangular rear wall 16. The blank 101 further has a lower transverse bending line 12 defined in a lower portion of the front surface of the blank 101 and extending parallel to the bending line 11 between the transverse edges of the blank 101. The bending line 12, the bending line 11, the bending lines 9, 9, and the transverse edges of the blank 101 jointly define a pair of rectangular side walls 17, 17. The bending line 12, the bending line 11, and the bending lines 9, 9 jointly provide a rectangular rear wall 18. In addition, the bending line 12, the bending lines 9, 9, and the transverse and lower edges of the blank 101 jointly form a pair of rectangular side walls 19, 19, and the bending line 12, the bending lines 9, 9, and the lower edge of the blank 101 jointly define a rectangular rear wall 20.

The lefthand (as shown in FIG. 1) side walls 15, 17, 19 have pegs 21 located closely to the lefthand transverse edge of the blank 101, and the righthand side walls 15, 17, 19 have openings 22 located closely to the righthand transverse edge of the blank 101, the pegs 21 being engageable in the openings 22, respectively. The rear walls 14, 18 have support projections 23, respectively. A hook-shaped locking tongue 24 projects downwardly from the lower edge of the blank 101 in alignment with the rear wall 20, there being a bending line 25 positioned where the locking tongue 24 is joined to the lower edge of the blank 101. The locking tongue 24 has a locking tooth 26 at its distal end and a through hole 27 defined in a bent corner of the locking tongue 24.

A blade holder 28, separate from the blank 101, has a fitting slot **28*a* defined in a lower surface thereof. By inserting a pair of lateral ridges 2*a*, 2*a* on the blade holder mount 2 into the fitting slot 28*a*, the blade holder 28 is mounted on the blade holder mount 2. The blade holder 28 holds a blade 102 with its edge exposed on the side of the front surface of the blank 101**.

Figure 2:
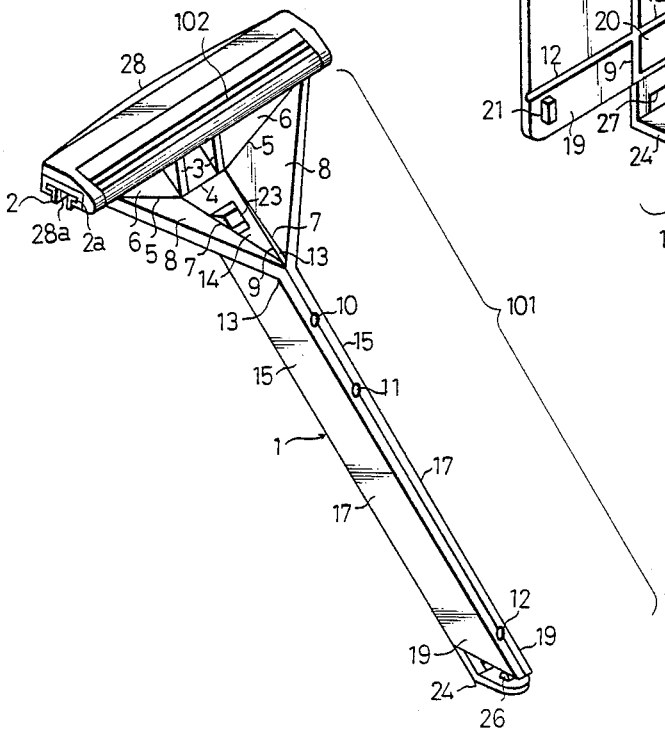
FIG. 2 is a perspective view of the safety razor shown in FIG. 1, the safety razor being folded in an operative condition.

To assemble the safety razor into an operative condition for use, the blade holder 28 is mounted on the blade holder mount 2 in the manner described above, and then all of the side walls 13, 15, 17, 19 are bent from the position of FIG. 1 forward around the bending lines 9, 9 in the directions of the arrows 111 until their edges are overlapped. When the pegs 21 are fitted respectively into the openings 22, the upper blade holder supports 6 are slightly tilted along the bending lines 4, 5 while at the same time the lower blade holder supports 8 are spread forward along the bending lines 7, as illustrated in FIG. 2. The walls 13, 14, 15, 16, 17, 18, 19, 20 between the bending lines 7 and the lower edge of the blank 101 now jointly constitute a razor handle or grip 1 for use in an operative condition.

Figure 3:
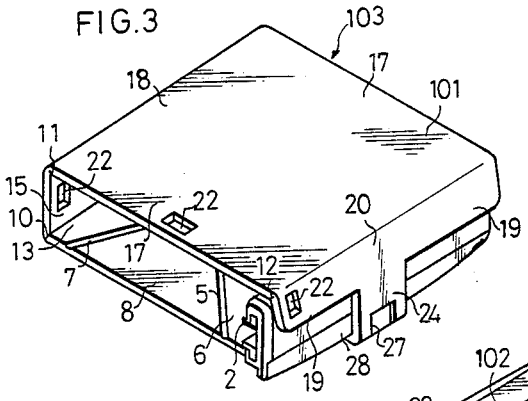
FIG. 3 is a perspective view of the safety razor of FIG. 1 folded in a storage condition.
Figure 4:
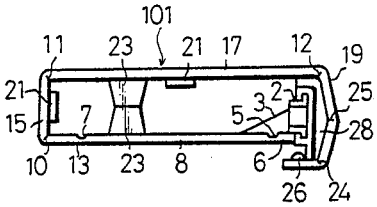
FIG. 4 is a side elevational view of the safety razor in the storage condition.

When the blank 101 is swung from the postion of FIG. 1 around the transverse bending lines 10, 11, 12 in the directions of the arrows 112, and the locking tooth 26 on the locking tongue 24 is brought into engagement with a rear lower edge of the blade holder 28, as shown in FIG. 4, the blank 101 is folded into a case 103 in the form of a rectangular parallelepiped as shown in FIG. 3. In this folded condition, the blade holder 28 and the blade holder mount 2 are stored in the case 103. At this time, the support projections 23, 23 are held in abutment against each other to prevent the case 103 from being collapsed or otherwise deformed.

With the present invention, the blade holder 28 is separate from the blank 101, and the blade holder mount 2 for mounting the blade holder 28 thereon is integrally formed with the upper edge of the blank 101. Therefore, no bending line is present between the blade holder mount 2 and the blank 101, and the blade holder 28 is prevented from moving or vibrating up and down during use to thereby facilitate shaving. Any unwanted movement or vibration of the blade holder 28 is also prevented reliably by the pair of stiffening ribs 3 which increase the strength with which the blade holder mount 2 is joined to the blank 101.

Figure 7:
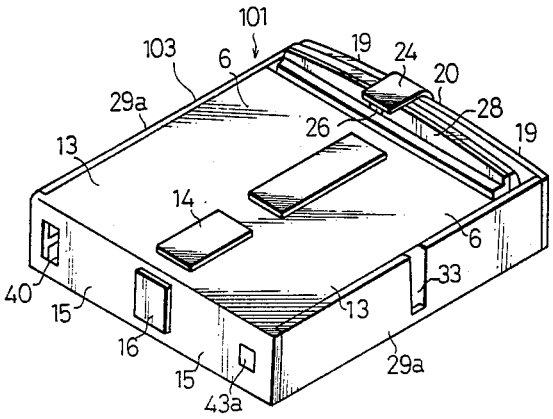
FIG. 7 is a perspective view of the safety razor of FIG. 5 folded in a storage condition.
Figure 8:
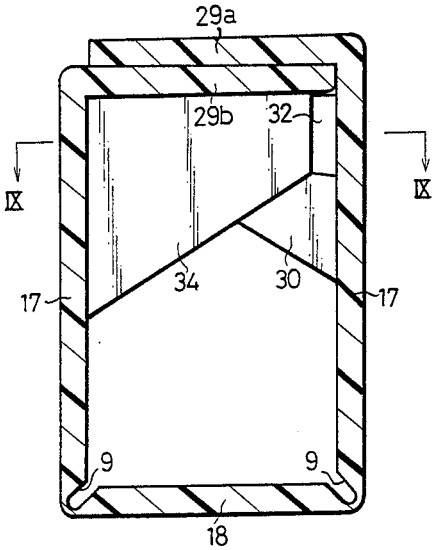
FIG. 8 is an enlarged cross-sectional view taken along line VIII—VIII of FIG. 6.
Figure 9:
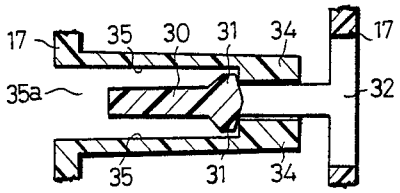
FIG. 9 is a cross-sectional view taken along line IX—IX of FIG. 8.

FIGS. 5 through 12 illustrate a safety razor according to a second embodiment of the present invention. The safety razor of the second embodiment is different from the safety razor of the first embodiment in that a blank 101 has a pair of rectangular side lids **29*a* 29*b* extending from the transverse edges of the blank 101 in transverse alignment with side walls 17, 17, respectively. There is an engagement plate 30 attached centrally to and disposed between both of an inner surface of one of the side lids 29*a* and a front surface of a corresponding one of the side walls 17 which is joined to the side lid 29*a*. The engagement plate 30 has a pair of locking ledges 31, 31 projecting centrally on its both surfaces, there being an aperture 32 defined behind the ledges 31 in both the engagement plate 30 and the side wall 17. The other side lid 29*b* has a central aperture 33 and a pair of engagement plates 34, 34 extending in spaced relation from upper and lower side edges of the recess 33 toward the side lid 29*a*. As shown in FIG. 9, the engagement plates 34, 34 have recesses 35, 35 defined in confronting surfaces thereof for receiving the locking edges 31, 31, respectively. The side wall 17 has a hole 35*a* communicating with the recesses 35, 35. The engagement plates 30, 34 also serve as ribs for reinforcing the side lids 29*a***, 29*b* projecting forward from the side walls 17, 17, respectively. The side lids 29*b* has a pair of stiffening ribs 36 disposed upwardly and downwardly of the engagement plates 34.

Figure 5:
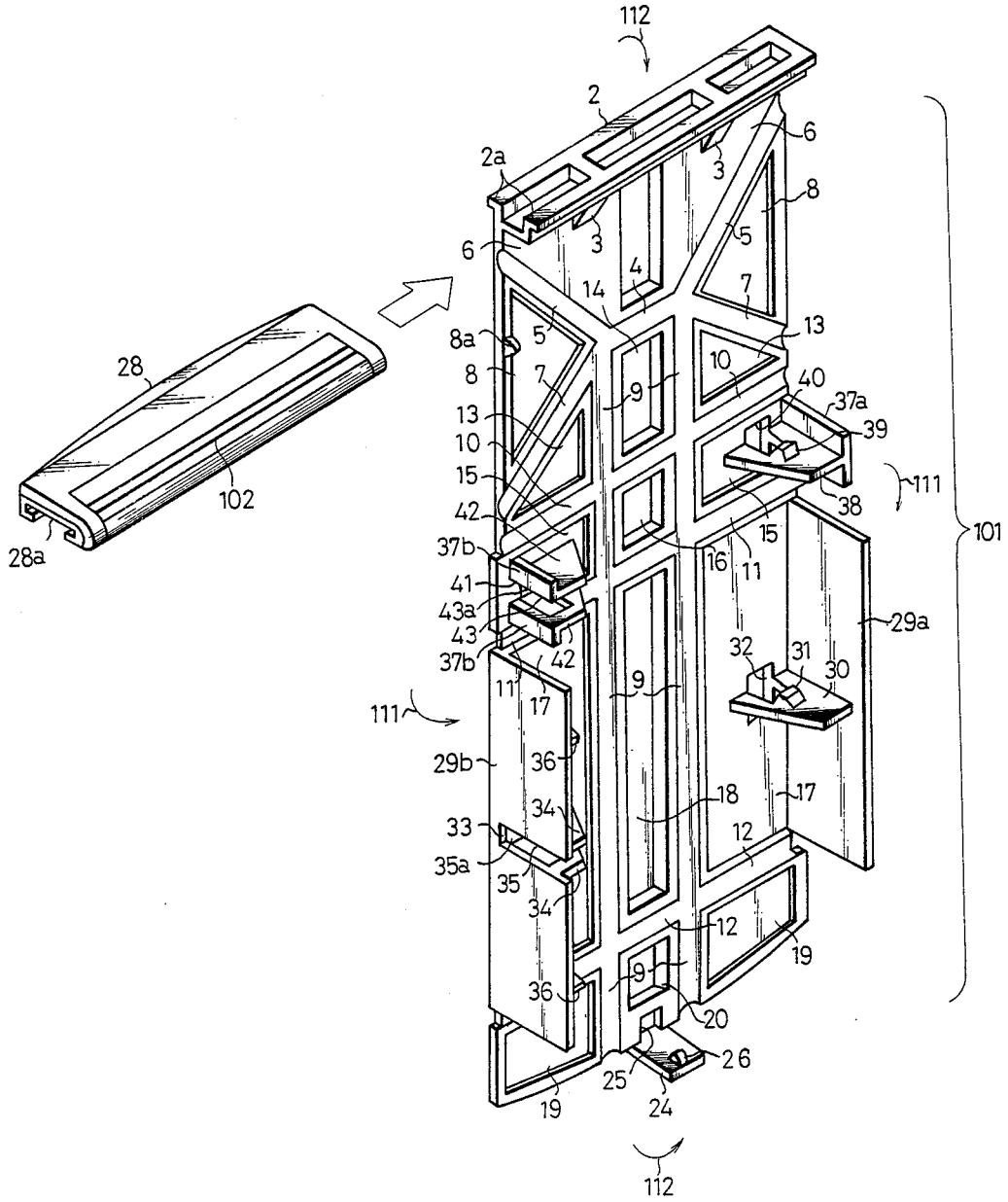
FIG. 5 is an exploded perspective view of a safety razor according to a second embodiment of the present invention, showing a unfolded blank of the safety razor and a blade holder.

A righthand (as shown in FIG. 5) side wall 15 has a side lid 37*a*, an engagement plate 38, a pair of locking ledges 39, and an aperture 40, as with the side wall 17 having the side lid 29*a*. A lefthand side wall 15 has a side lid 37*b*, an aperture 41, a pair of engagement plates 42, a pair of recesses 43, and a hole 43*a*, as with the side wall 17 having the side lid 29*b*. A lefthand lower blade holder support 8 has a projection 8*a* extending forward on the transverse edge thereof. The projection 8 will be inserted in the aperture 33 in the lefthand side lid 29*b* when the blank 101 is folded into a case. The blank 101 according to the second embodiment has no support projections such as the support projections 23 in the first embodiment.

The safety razor of the second embodiment mainly differs from the safety razor of the first embodiment as described. While in the first embodiment the case 103 with the blade holder 28 stored therein is open at lateral sides as illustrated in FIG. 3, such lateral sides are closed off by the side lids 29*a*, 29*b* as shown in FIG. 7 according to the second embodiment so that shaving cream and the like in addition to the blade holder 28 can be stored in the closed space in the case 103. In the folded condition, both of the lower blade holder supports 8 are held in abutment against the engagement plates 30, 34, preventing the case 103 from being collapsed.

Figure 6:
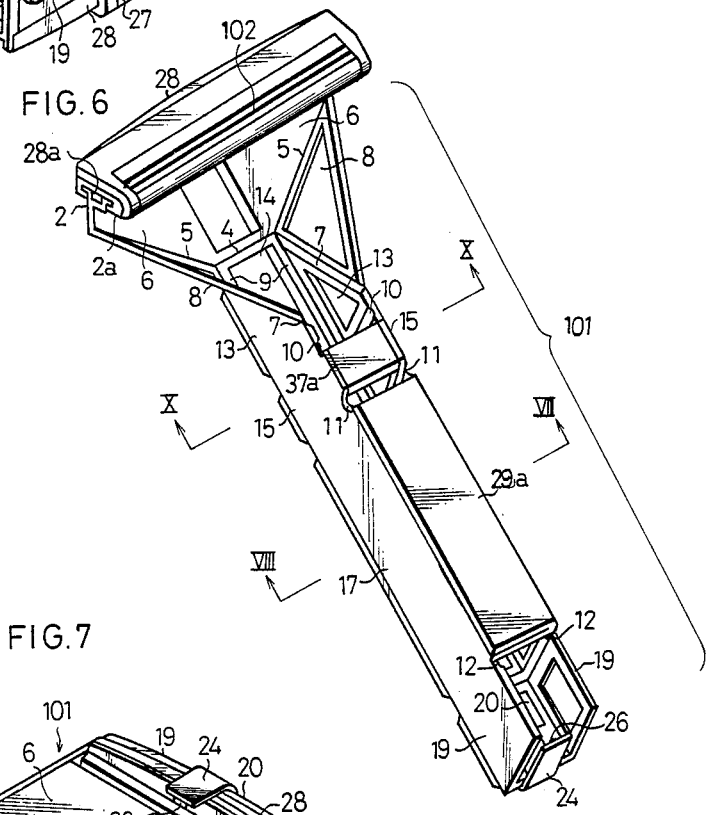
FIG. 6 is a perspective view of the safety razor shown in FIG. 5, the safety razor being folded in an operative condition.
Figure 10:
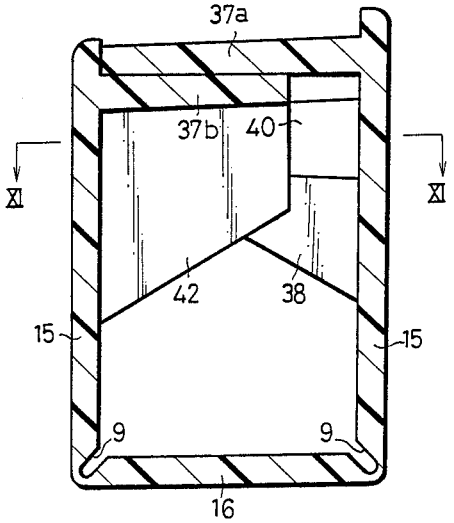
FIG. 10 is an enlarged cross-sectional view taken along line X—X of FIG. 6.
Figure 11:
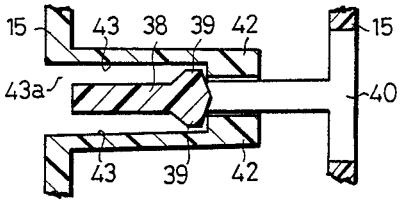
FIG. 11 is a cross-sectional view taken along line XI—XI of FIG. 10.
Figure 12:
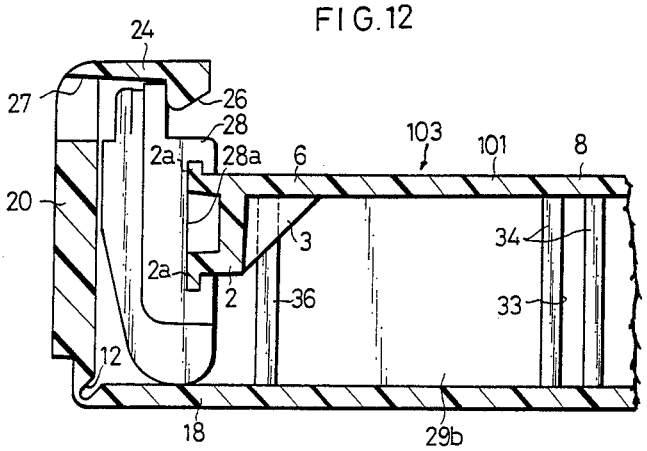
FIG. 12 is an enlarged fragmentary cross-sectional view of a blade holder stored in a case illustrated in FIG. 7.

In an operative condition for use as shown in FIG. 6, the side lids 29*a*, 29*b* and the side lids 37*a*, 37*b* are brought into overlapping relation as illustrated in FIGS. 8 and 10 and serve as a front surface of the handle or grip having a square cross section. At this time, the engagement plates 30, 38 are clamped bewteen the engagement plates 34, 34 and 42, 42, respectively, as shown in FIGS. 9 and 11, with the locking ledges 31, 39 engaging in the recesses 35, 43.

Figure 13:
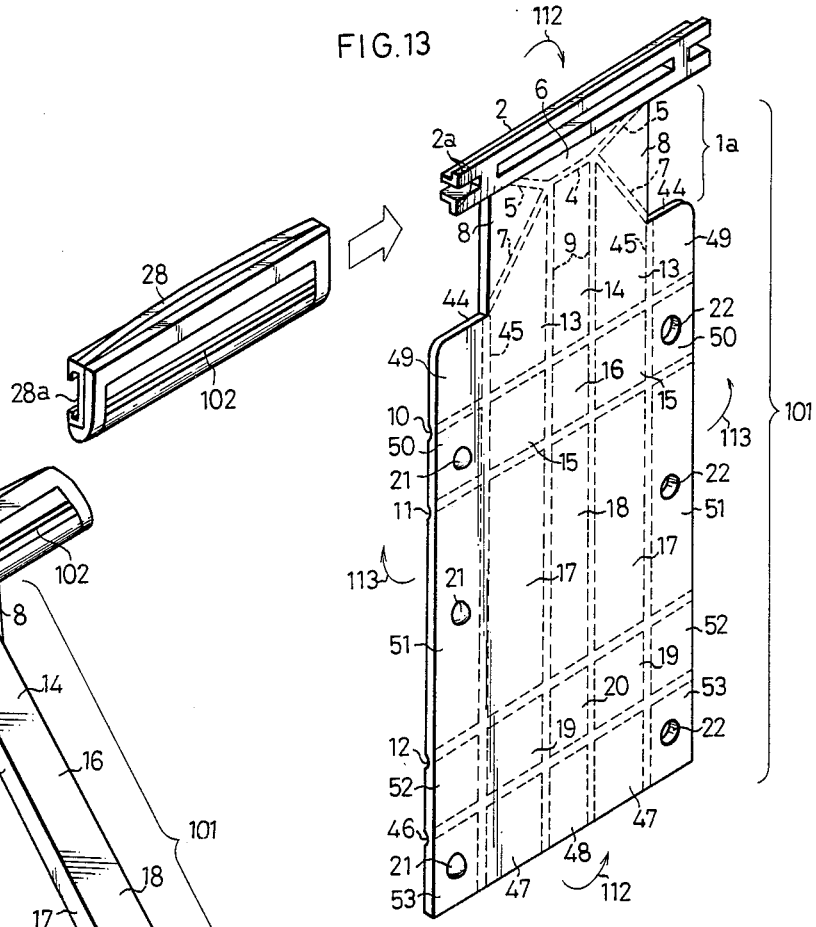
FIG. 13 is an exploded perspective view of a safety razor according to a third embodiment of the present invention, showing a unfolded blank of the safety razor and a blade holder.
Figure 14:
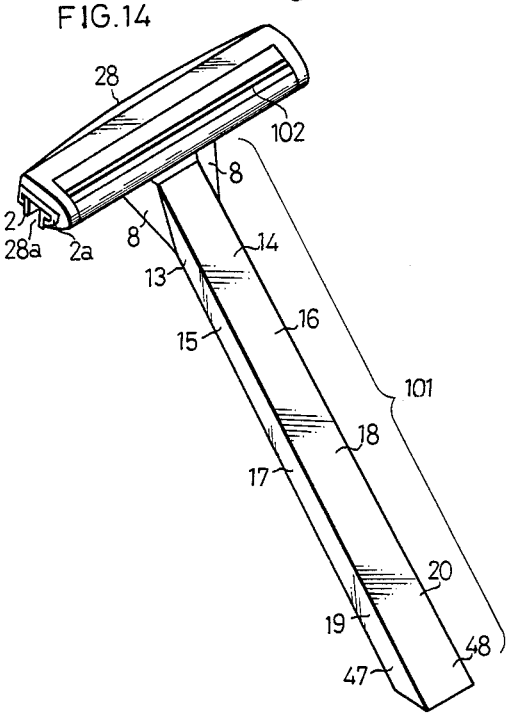
FIG. 14 is a perspective view of the safety razor shown in FIG. 13, the safety razor being folded in an operative condition.
Figure 15:
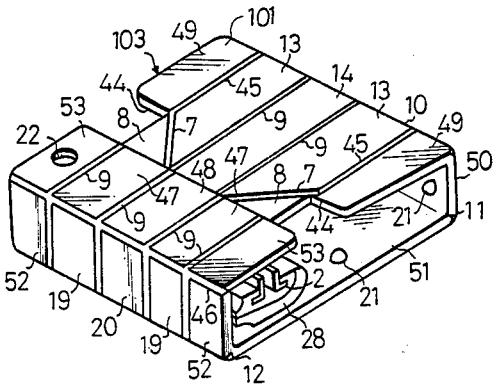
FIG. 15 is a perspective view of the safety razor of FIG. 13 folded in a storage condition.

According to a third embodiment shown in FIGS. 13 through 15, a blank 101 has a pair of steps 44 defined in an upper edge thereof on the transverse edges, thus providing a narrower neck 1*a* on the upper edge of the blank 101. A blade holder mount 2 is integrally formed with an upper edge of the neck 1*a*, the blade holder mount 2 being wider than the neck 1*a*. The blade holder mount 2 projects downwardly in front of the blank 101. In the first embodiment the stiffening ribs 3 and the bending lines 4, 5, 7, 9, 10, 11, 12 are formed on the front surface of the blank 101. In the third embodiment, however, such stiffening ribs and bending lines are formed on a rear surface of the blank 101. A pair of additional bending lines 45, 45 is defined in the rear surface of the blank 101 and extends from the bending lines 7 at the corners of the steps 44 downwardly toward the lower edge of the blank 101. The blank 101 also has a transverse bending line 46 defined in a lower portion of the rear surface thereof and extending parallel to the lower bending line 12 between the transverse edges of the blank 101. The bending lines 4, 5, 7, 9, 10, 11, 12, 45, 46 jointly define blade holder supports 6, 8, side walls 13, 15, 17, 19, 47, front walls 14, 16, 18, 20, 48, and rear walls 49, 50, 51, 52, 53. The lefthand (as shown in FIG. 13) rear walls 50, 51, 53 have pegs 21, respectively, on their front surfaces, and the righthand rear walls 50, 51, 53 have openings 22, respectively, in which the pegs 21 can engage.

The blank 101 can be brought from the unfolded condition of FIG. 13 into an operative condition for use by bending all of the side walls 13, 15, 17, 19, 47 around the vertical bending lines 9 rearward in the directions of the arrows 113, then bending all of the rear walls 49, 50, 51, 52, 53 around the bending lines 45 in the directions of the arrows 113 until the rear walls are overlapped, and bringing the pegs 21 into the openings 22. The upper blade holder supports 6 are now slightly tilted backward along the bending lines 4, 5, and the lower blade holder supports 8 are spread away from each other backward along the bending lines 7, as shown in FIG. 14.

With the first embodiment, the lower blade holder supports 8 project forward of the handle 1 and tends to contact the user's skin when the user shaves himself with the blade 102 projecting from the front side of the blade holder 28. According to the third embodiment, however, the blade holder supports 8 project rearward of the handle 1 leaving a space in front of and below the blade holder 28. The safety razor of the third embodiment can therefore be used more easily without the tendency of the blade holder supports 8 to contact the user's skin.

Furthermore, the safety razor of the third embodiment is more advantageous than those of the first and second embodiments in that the blade holder supports 8 support the blade holder 28 at a position close to a longitudinal center thereof, resulting in a greater capability in supporting the blade holder 28 reliably against any tendency to move or vibrate up and down. The blade holder supports 8 also serve as stiffening ribs as described with reference to the first embodiment.

When the blank 101 is bent from the unfolded condition of FIG. 13 around the transverse bending lines 10, 11, 12, 46 in the directions of the arrows 112, the blank 101 is folded into a case 103 in the form of a rectangular parallelepiped with the walls 47, 48, 53 along the lower edge of the blank 101 covering the blade holder 28.

The terms "upper", "lower", "front", "rear", "forward", and "rearward" are used in the specification and claims with particular reference to the position which the safety razor assumes during normal usage.

Although certain preferred embodiments have been shown and described, it should be understood that many changes and modifications may be made therein without departing from the scope of the appended claims.

What is claimed is:

1. A safety razor comprising a blank having a plurality of transverse and longitudinal bending lines defined thereon, said blank being foldable selectively around selected ones of said bending lines into a razor handle of a rectangular cross section and around other bending lines than said selected ones into a box-shaped case, a blade holder mount integrally formed with an upper edge of said blank, and a blade holder separate from and adapted to be mounted on said blade holder mount, said blade holder being accommodatable in said case and having a blade mounted thereon, said bending lines include a central transverse bending line extending transversely in an upper portion of said blank, two pairs of upper and lower oblique bending lines extending from opposite ends of said central transverse bending line obliquely upwardly and downwardly, respectively, toward transverse edges of said blank, a pair of longitudinal bending lines extending from said opposite ends of said central transverse bending line toward a lower edge of said blank, and three transverse bending lines extending fully across said blank below said pair of lower oblique bending lines, said blank including a pair of upper triangular blade holder supports defined between said pair of upper oblique bending lines and said upper edge of said blank, a pair of lower triangular blade holder supports defined between said upper and lower oblique bending lines and said transverse edges of said blank, and a plurality of central and side walls defined between said central transverse bending line, said lower oblique bending lines, and said longitudinal and transverse bending lines, the arrangement being such that when said side walls are bent forward around said pair of longitudinal bending lines, said upper blade holder supports are tilted forward along said central transverse bending line and said upper oblique bending lines, and said lower blade holder supports are spread obliquely forward along said lower oblique bending lines, thereby allowing said plurality of walls to constitute a razor handle, and when said blank is folded forward around said three transverse bending lines, said upper and lower blade holder supports and said plurality of walls jointly constitute a case in which said blade holder and said blader holder mount are accommodated, said blank has a pair of rectangular lids projecting forward from said transverse edges in transverse alignment with the walls defined by said longitudinal bending lines and intermediate and lower transverse bending lines of said three transverse bending lines, said lids serving as side walls of said case when said blank is folded along said three transverse bending lines, said lids can overlap each other to provide a front side wall of said razor handle when said blank is folded along said longitudinal bending lines, a plurality of engagement plates mounted on inner surfaces of said lids and detachably engageable with each other when said lids overlap each other, wherein one of said engagement blades has a pair of locking ledges respectively on opposite surfaces thereof, and the other engagement plates have a recess defined therebetween for engagement therein of said locking ledges.

2. A safety razor according to claim 1, wherein said blade holder projects forward from said upper edge of said blank, including stiffening means connected to said blade holder mount and said blank for increasing the strength with which said blade holder mount and said blank are interconnected and for preventing said blade holder from vibrating longitudinally of said blank during use.

3. A safety razor according to claim 2, wherein said stiffening means comprises a pair of stiffening ribs interconnecting a lower surface of said blade holder and an upper front surface of said blank.

4. A safety razor according to claim 1, wherein said one of the engagement plates is connected to and disposed between one of said lids and the wall contiguous thereto, and said other engagement plates are connected to and disposed between the other lid and the wall contiguous thereto, said engagement plates serving as ribs for maintaining said lids erected on said blank.

5. A safety razor according to claim 4, wherein said engagement plates are held at their distal ends in engagement with said lower blade holder supports when said blank is folded into said box-shaped case, thereby preventing said case from being collapsed.

6. A safety razor according to claim 3, wherein said blank includes a locking tongue projecting forward from a central lower edge thereof for engagement with said blade holder, said locking tongue being engageable with said blade holder when said blank is folded into said box-shaped case, thereby maintaining the box-shaped configuration of said case.

7. A safety razor according to claim 6, wherein said locking tongue has a locking tooth for engaging a rear portion of said blade holder.

8. A safety razor comprising a blank having a plurality of transverse and longitudinal bending lines defined thereon, said blank being foldable selectively around selected ones of said bending lines into a razor handle of a rectangular cross section and around other bending lines than said selected ones into a box-shaped case, a blade holder mount integrally formed with an upper edge of said blank, and a blade holder separate from and adapted to be mounted on said blade holder mount, said blade holder being accommodatable in said case and having a blade mounted thereon, said bending lines include a central transverse bending line extending transversely in an upper portion of said blank, two pairs of upper and lower oblique bending lines extending from opposite ends of said central transverse bending line obliquely upwardly and downwardly, respectively, toward transverse edges of said blank, a pair of longitudinal bending lines extending from said opposite ends of said central transverse bending line toward a lower edge of said blank, and three transverse bending lines extending fully across said blank below said pair of lower oblique bending lines, said blank including a pair of upper triangular blade holder supports defined between said pair of upper oblique bending lines and said upper edge of said blank, a pair of lower triangular blade holder supports defined between said upper and lower oblique bending lines and said transverse edges of said blank, and a plurality of central and side walls defined between said central transverse bending line, said lower oblique bending lines, and said longitudinal and transverse bending lines, the arrangement being such that when said side walls are bent forward around said pair of longitudinal bending lines, said upper blade holder supports are tilted forward along said central transverse bending line and said upper oblique bending lines, and said lower blade holder supports are spread obliquely forward along said lower oblique bending lines, thereby allowing said plurality of walls to constitute a razor handle, and when said blank is folded forward around said three transverse bending lines, said upper and lower blade holder supports and said plurality of walls jointly constitute a case in which said blade holder and said blade holder mount are accommodated, said blank has a pair of rectangular lids projecting forward from said transverse edges in transverse alignment with the walls defined by said longitudinal bending lines and upper and intermediate transverse bending lines of said three transverse bending lines, said lids overlapping each other to provide a front side wall of said razor handle when said blank is folded along said longitudinal bending lines, said lids including a plurality of engagement plates mounted on inner surfaces of said lids and detachably engageable with each other when said lids overlap each other, one of said engagement plates having a pair of locking ledges respectively on opposite surfaces thereof, and the other engagement plates having a recess defined therebetween for engagement therein of said locking ledges.

* * * * *